United States Patent [19]

Marshall et al.

[11] Patent Number: 4,621,949

[45] Date of Patent: Nov. 11, 1986

[54] BUOYANT TOWER FLEXURE JOINT

[75] Inventors: Peter W. Marshall; Paul R. Johnson, both of Houston, Tex.

[73] Assignee: Shell Oil Company, Houston, Tex.

[21] Appl. No.: 685,654

[22] Filed: Dec. 24, 1984

[51] Int. Cl.[4] ..... E02B 17/02

[52] U.S. Cl. ..... 405/202; 405/205; 405/227

[58] Field of Search ..... 405/195, 202, 203, 205, 405/207, 208, 211, 224, 227

[56] References Cited

U.S. PATENT DOCUMENTS 3,592,012 7/1971 Mott ..... 405/227
3,645,104 2/1972 Hogan ..... 405/208
3,745,777 7/1973 Blenkarn ..... 405/211

FOREIGN PATENT DOCUMENTS 1395297 5/1975 United Kingdom ..... 405/227
2123883 2/1984 United Kingdom ..... 405/227

*Primary Examiner*—David H. Corbin

[57] ABSTRACT

A flexure joint is formed at the base of a buoyant tower structure by piles driven into the ocean floor. The geometric arrangement of these piles increases the buoyant tower's resistance to lateral forces at the base, while allowing rotational displacement about any horizontal axis, and also allows wells to be directed through the piles to formations located a substantial distance from the tower.

14 Claims, 5 Drawing Figures

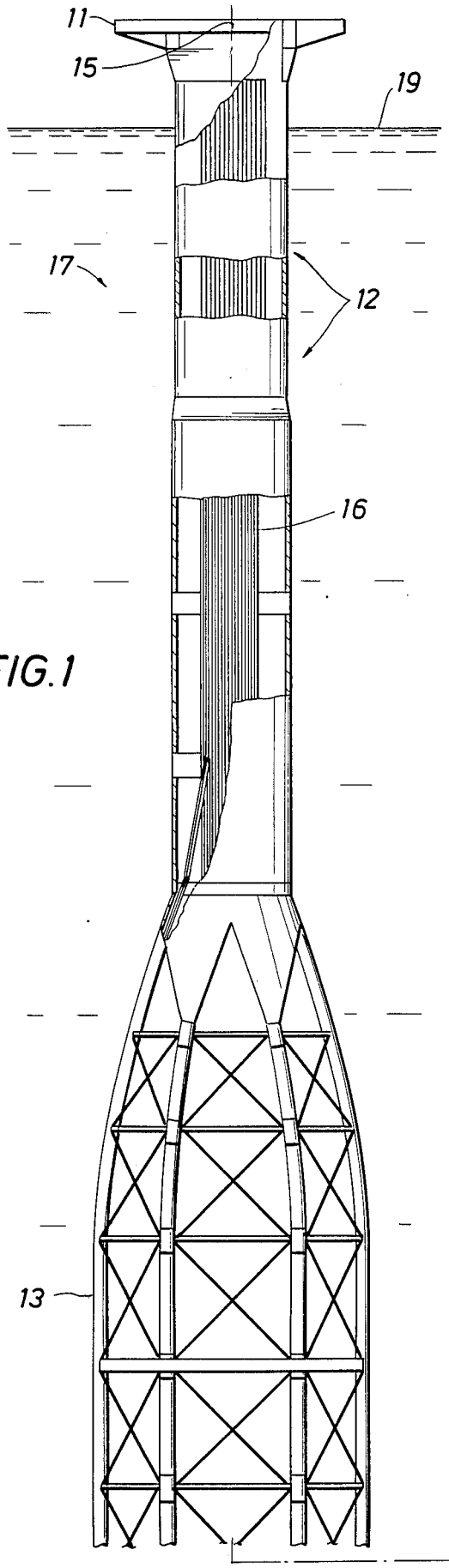
FIG.1
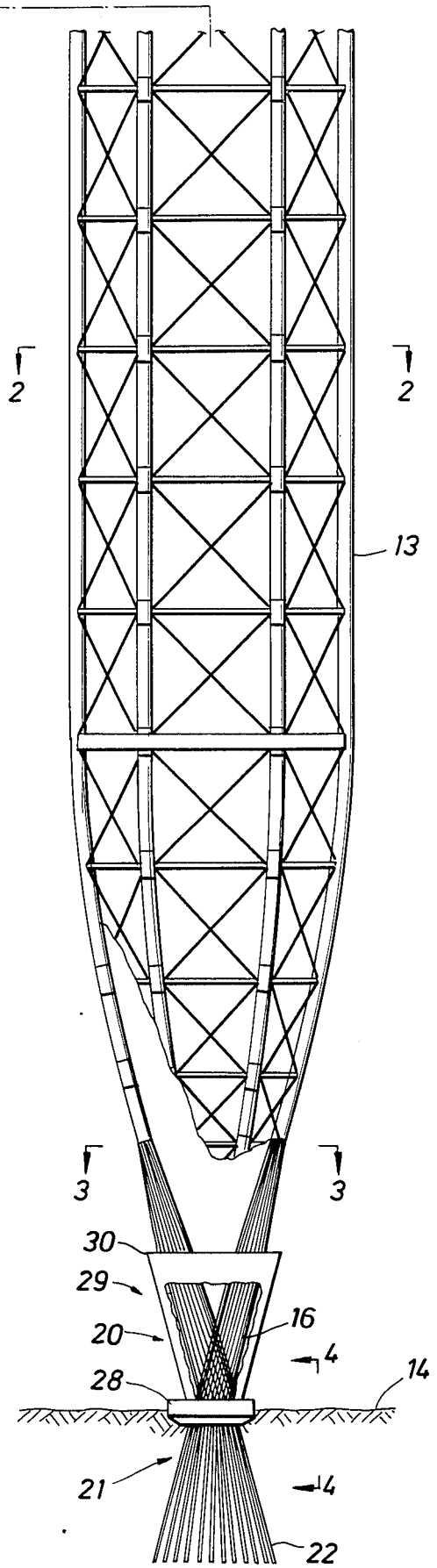

BUOYANT TOWER FLEXURE JOINT

BACKGROUND OF THE INVENTION

1. Field of the Invention

The invention relates to an apparatus used to secure an offshore buoyant tower structure to the ocean floor.

2. Description of the Prior Art

In the positioning of a floatable or semi-submersible marine structure in an offshore body of water, the method normally followed is to anchor the structure by use of anchors and lines which radiate downwardly from the structure. In the instance of a self-supporting or buoyant tower structure for use in deeper water, however, with a single upstanding column-like member that is controllably buoyant in the water, the lower portion of such a buoyant tower member must be firmly anchored to the ocean floor such that the column will, under the influence of wind, waves and other elements, be permitted only a limited degree of oscillatory movement about a fixed lower end.

To achieve such a purpose, the lower or base end must be so firmly embedded or weighted to the ocean floor that, in effect, it will tether the buoyant tower structure to the ocean floor. Anchoring can assume a number of forms presently known and including primarily the use of vertical piling which is normally embedded downward into the substratum a sufficient distance to be held in position by the subsoil. To offset the tower's buoyancy ballast may also be used near the base of the tower. In any event, the piles must also resist the lateral movement of the buoyant column and supplementary "shear piles" may be added for this purpose.

As described in U.S. Pat. No. 3,488,967, entitled "Combination Deep Water Storage Tank and Drilling and Production Platform", filed Mar. 23, 1967, and subsequently issued to Mr. M. Toossi, Jan. 13, 1970, a circular arrangement of vertical piles can also be used to form the column structure of the buoyant tower. Wells may also be drilled vertically downward through these piles, though it is well recognized that use of a curved or inclined pile to direct the well into the substratum would allow the well to be drilled into more distant hydrocarbon bearing formations.

Due to lateral and rotational movement of the buoyant structure means must also be used at the ocean floor to reduce the resultant shear and bending stresses encountered in the piles. As described in U.S. Pat. No. 3,648,638, entitled "Vertically Moored Platforms", filed Mar. 9, 1970, and subsequently issued to Mr. K. Blenkarn, Mar. 4, 1972, ball joints may be incorporated into the piles adjacent the ocean floor, or a ball joint may be used in the column, above the piles.

But use of these ball joints necessarily increases the cost and complexity of assembly of the underwater structure and leaves the integrity of the structure dependent upon the ball joints' continued operation.

An apparatus needs to be developed therefore that is not dependent upon the proper operation of mechanical stress compensation devices. The same apparatus should also not limit the drilling of wells to formations disposed vertically beneath the structure.

SUMMARY OF THE INVENTION

The apparatus of the present invention comprises piles oriented at the ocean floor so as to form at least two concentric rings, the orientation of the batter or inclination of the piles of one ring being opposite the orientation of the batter or inclination of the piles of the other ring. The resultant flexure joint formed by the orientation of these concentric rings at the ocean floor eliminates the need for cumbersome ball joints.

The close spacing of the piles at the base of the column minimizes stress due to oscillatory sway movements of the tower, while the orientation or "batter" of the piles aids in resisting lateral movement and large horizontal forces at the base of the column.

The flexure joint also compliantly resists rotational movement of the structure about the structure's longitudinal axis due to the opposite inclination of the members of each separate ring. Since the individual piles forming the rings are inclined upon entry into the substratum, wells drilled from these piles may be directionally inclined into more distant formations than those accessible if purely vertical conduits were used to direct a drill string into the substratum.

Additionally, the concentric ring concept provides an ideal pattern for drilling wells due to the minimum interference of each well with the adjacent wells as each well leaves the rather congested area at the base of the structure.

Thus, according to the invention, there is provided for use in offshore well operations, a buoyant tower adapted to extend to the bottom of a body of water having a central vertical axis comprising buoyant tank means located adjacent the upper end of said tower, and a plurality of pile guides extending downwardly through said buoyant tower, said pile guides bending inwardly toward each other adjacent the bottom of said tower to form a flexure joint housing. Piles carried within the pile guides of the flexure joint housing form the upper portion of the flexure joint. The same piles extend below the housing and form the lower portion of the same flexible joint.

An object of the invention is to provide an improved means for anchoring a buoyant tower structure to the ocean floor. Another object of the invention is to provide a flexure joint to allow tilt movement of the buoyant tower relative to the ocean floor while restraining lateral movement. Another object is to provide a flexure joint which allows the slant drilling of wells to distant formations not located beneath the buoyant tower. Another object of the invention is to provide a flexure joint which provides maximum structural strength with minimum material. Other aspects, objects, and advantages of the invention will be apparent to those skilled in the art in view of this disclosure.

BRIEF DESCRIPTION OF THE DRAWING

FIG. 1 is a schematic representation of a buoyant tower moored to the bottom of a body of water.

DESCRIPTION OF THE PREFERRED EMBODIMENT

Figure 2:
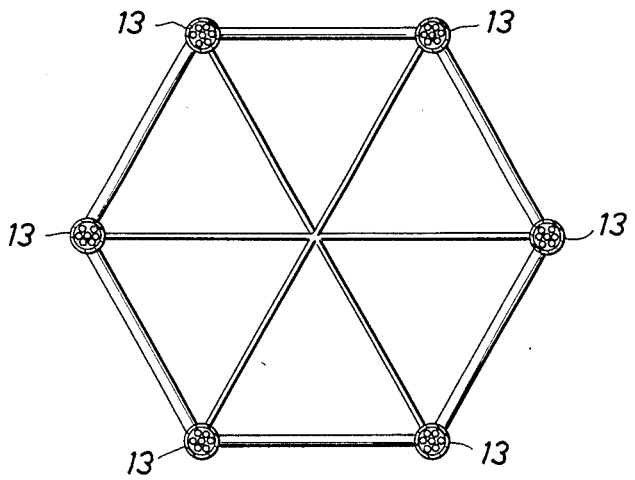
FIG. 2 is a schematic view in cross section taken along lines 2—2 of FIG. 1 illustrating the truss configuration of the large diameter buoyant tower legs.

A buoyant tower structure 17 having a central vertical axis 15 is shown positioned in a body of water 19 supporting a platform 11 at its upper end. Buoyant tank means 12 supplies positive buoyancy to maintain the structure 17 in approximately a vertical position. Pile guides 16 are shown leaving the platform 11, being gathered into separate bundles, each bundle passing through a large diameter leg 13, thereafter traveling downward and inward and ending at the pile guide support base 28 shown at the bottom of the body of water 14. Piles 22, are shown extending downwardly and outwardly from the pile guide support base 28, these piles 22, having been driven down through the pile guides 16 during the installation of the tower structure 17. This installation is accomplished by upending the entire structure (as it originally floats horizontally upon the surface of the body of water), and subsequently embedding the pile guide support base 28 into the bottom of said body of water 14. Piles 22 are then driven through the pile guides 16, so that they enter into the bottom of the body of water 14 at an inclined angle. The piles 22 are vertical at the platform 11. Curvature of the pile guides 16 is generally limited to approximately 6° per 100 feet to limit stresses in the piles 22 and to provide for subsequent convenient drilling of wells through the piles 22. One portion of piles 22 may be driven into the bottom at one angle of inclination to the vertical axis 15 of the buoyant tower 17 and another portion may be driven in at an opposite angle of inclination to the vertical axis 15 of the buoyant tower. These piles 22 may be either solid or hollow through their central section, in the latter case to allow drilling operations to be conducted through them, or simply for economy of material.

The flexure joint upper portion 20 and flexure joint lower portion 21 are shown arranged on opposite sides of and immediately adjacent to the pile guide support base 28. Each portion of the flexure joint 20, 21 is formed from piles 22. The piles 22, forming the flexure joint upper portion 20 are carried within the guide piles 16 which may be arrayed inside an enclosure 30 to form a flexure joint housing 29. The piles 22, which extend downwardly and outwardly below the pile guide support base 28 form the flexure joint lower portion 21.

In other words, the entire flexure joint 20, 21 is formed by piles 22. These piles 22, flex within the pile guides 16, in the upper portion of the flexure joint 20, and flex in the substratum sea floor materials in the lower portion of the flexure joint 21. The entire array of pile guides 16 and an enclosure 30 which may be placed at the lower end of the tower 17 forms a flexure joint housing 29.

As shown in FIG. 2, a cross-section taken through a section 2—2 of the buoyant tower structure 17 shows the truss structure formed from large diameter legs 13. The legs 13 in the preferred embodiment are spaced substantially equally about the circumference of the buoyant tower structure 17, though it is recognized that other typical configurations may be used, such as 3, 4, 6, or 8 legs.

Figure 3:
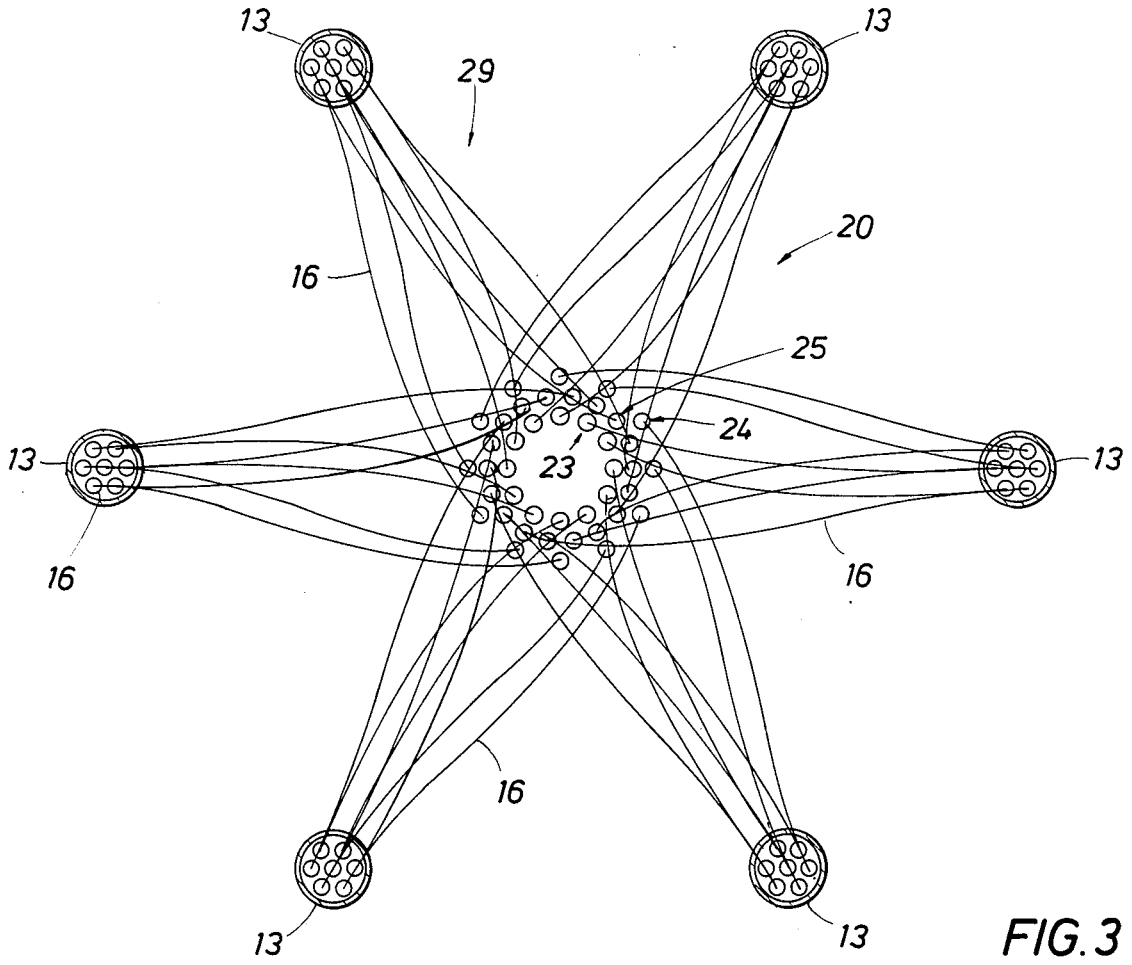
FIG. 3 is a schematic view in cross section taken along lines 3—3 of FIG. 1 illustrating pile guide routing from the large diameter buoyant tower legs to the flexure joint housing.

As shown in FIG. 3, a cross-section taken through the lower portion of the buoyant tower's structure 17 shows the pile guides 16 leaving their respective legs 13 and descending downwardly to form a flexure joint housing 29 which may be carried within the enclosure 30 (not shown for clarity).

In the preferred embodiment, a cluster of seven pile guides 16 is shown retained within each leg 13, though it is well recognized that other numbers of pile guides 16 may be carried within each leg 13. For example, one leg 13 may carry five pile guides 16 whereas another leg 13 may carry eight pile guides 16, or even none at all. Each pile guide 16 extends downwardly from one to the legs 13 toward the bottom of the body of water 14 and forms in combination with the other pile guides 16 a combined array consisting of three concentric layers or rings—an inner concentric ring 23, a middle concentric ring 25, and an outer concentric ring 24. These concentric layers or rings 23, 24 and 25 form the flexure joint housing 29.

It is recognized that these concentric rings 23, 24, and 25 need not be circular, nor need the piles be equally spaced. For example, each ring 23, 24, and 25 may retain the polygonal character of the tower. It should also be noted in viewing FIGS. 3 and 5, that the angle of inclination of the pile guides 16 forming each concentric ring 23, 24, or 25 is different from the angle of inclination of the pile guides forming adjacent concentric ring 23, 24, or 25. The deliberate "counterwinding" of each ring 23, 24, 25 with respect to the adjacent ring 23, 24, 25 balances the torque due to vertical loads and hinders rotation of the structure 17 about the central vertical axis 15, after piles 22 (FIG. 4) have been driven through the pile guides 16. Note that a minimum of two counterwound concentric rings 24, 25 must be utilized to effect this desired torque balance and rotation resistance, whereas in the preferred embodiment three concentric rings 23, 24, and 25 are shown. Minimization of rotational displacement in this manner allows efficient well drilling and producing operations to be conducted from the platform 11 and prevents potentially damaging twisting-up of the pile array formed by rings 23, 24, and 25.

Whereas the pile guides 16 in the preferred embodiment distribute evenly from each leg 13 to form separate concentric rings 23, 24, and 25, it is recognized that construction and fabrication limitations in assembling the entire flexure joint housing 29 may prevent an even distribution of the pile guides 16 into each respective concentric ring. For example, all pile guides 16 leaving one leg 13 may be used to form a portion of ring 25.

Although six large diameter legs 13 are shown in the preferred embodiment, it is recognized that a minimum of three legs 13 may be used to optimally stabilize the displacement of the structure 17 from wind, wave, and current forces.

Note that vertical wells may be drilled directly through the center of the inner concentric ring 23 to reach formations directly beneath the buoyant tower structure 17 if desired.

Figure 4:
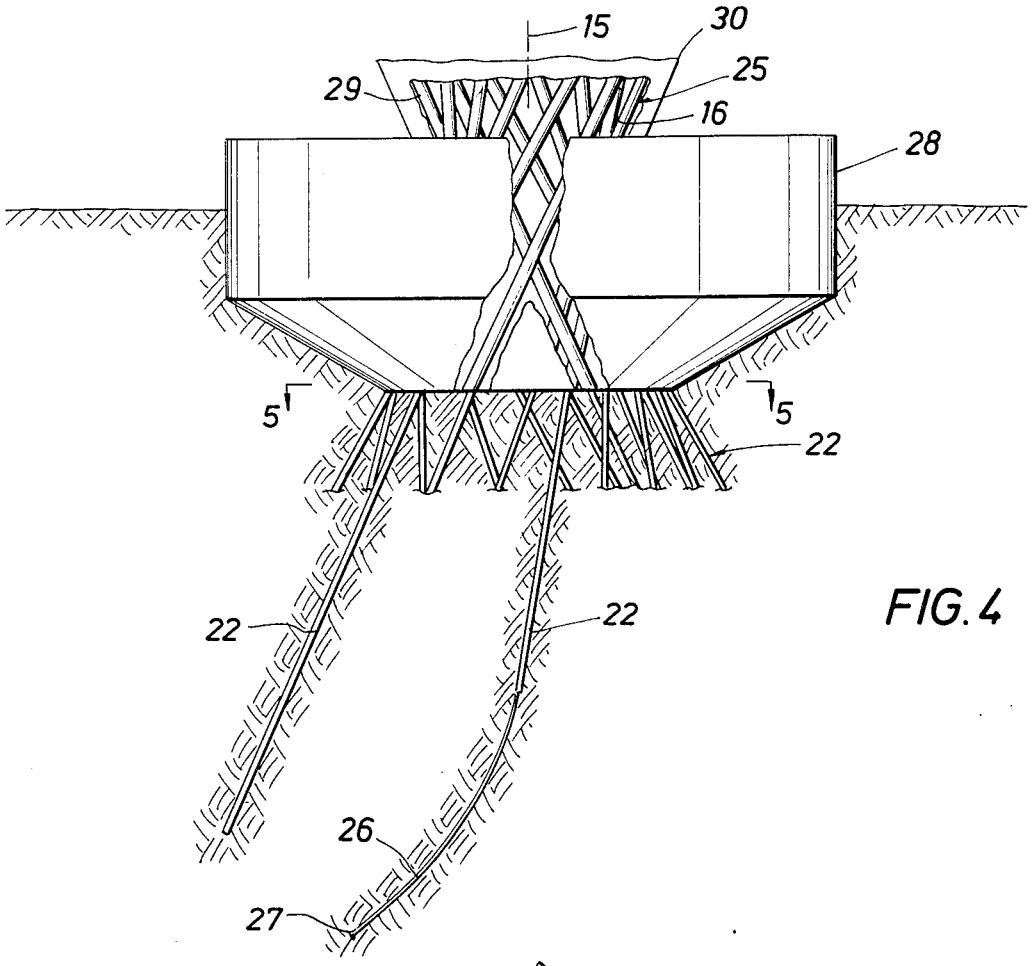
FIG. 4 is a schematic representation of pile guide and pile orientation.

The lower portion of the middle concentric ring 25 which forms a portion of the flexure joint housing 29 is shown in FIG. 4 connected to the pile guide support base 28. (The outer concentric ring 24 and the inner concentric ring 23 are not shown in FIG. 4 for the purpose of clarity). In the preferred embodiment, each pile guide 16 forming the middle concentric ring 25 and therefore a portion of the flexible joint housing 29 extends downwardly through the enclosure 30 to the lower surface of the pile guide support base 28 and terminates at that point.

Piles 22 are shown extending below the pile guide support base 28. Piles 22 may be driven below the pile guide support base 28 and be terminated at some distance below the pile guide support base 28 to act solely as an anchor device for the buoyant tower structure 17, or a drill string 26 carrying a drill bit 27 at its end may be extended down through the pile 22 by means well known to the art in order to drill to formations located beneath the bottom of the body of water 14. Not all pile guides 16 need carry piles 22 for the tower to be effectively anchored to the bottom of the body of water 14.

For clarity, it should be realized that the piles 22 are carried loosely within the pile guides 16 which along with an enclosure 30 that may surround and support the pile guides 16, form the flexible joint housing 29. In the preferred embodiment, the piles 22 have outside diameters of approximately 24 inches, whereby the pile guides 16 have a 27 inch outer diameter and 25.5 inch inner diameter, thereby leaving a $\frac{3}{4}$ inch clearance between the piles 22 and pile guides 16. This clearance allows flexure of the piles 22 within the pile guides 16 which form the flexure joint housing 29. The pile guides 16 may be supported by an enclosure 30 formed about the guides 16. The stiffness of this enclosure 30 may allow the pile guides 16 additional flexibility while contained within the enclosure 30.

Clearance between piles 22 and guides 16 is also necessary for the installation of the buoyant tower structure 17. During the installation process, the structure 17 is initially floated horizontally upon the surface of the body of water 14. Flooding of the buoyant tank 12 and other adjustment made by surface equipment causes the structure 17 to assume an upright vertical orientation. Upon additional buoyant tank 12 flooding, the pile guide support base 28 becomes embedded in the bottom of the body of water 14. The pile guide support base 28 is carried by the bottom of the body of water 14, effectively forming a "mud mat", (or spud can) as is well known to the art, for the entire buoyant tower structure 17 during its installation. Piles 22 are then selectively driven down through pile guides 16, the clearance between the piles 22 and pile guides 16 allowing passage of the piles 22 through the pile guides 16. Driving these piles 22 through the pile guides 16 and into the bottom of the body of water 14 forms the desired flexure joint 20, 21 (FIG. 21 capable of limiting displacement of the buoyant tower structure 17, and also capable of anchoring the structure 17 to the bottom of the body of water 14.

Figure 5:
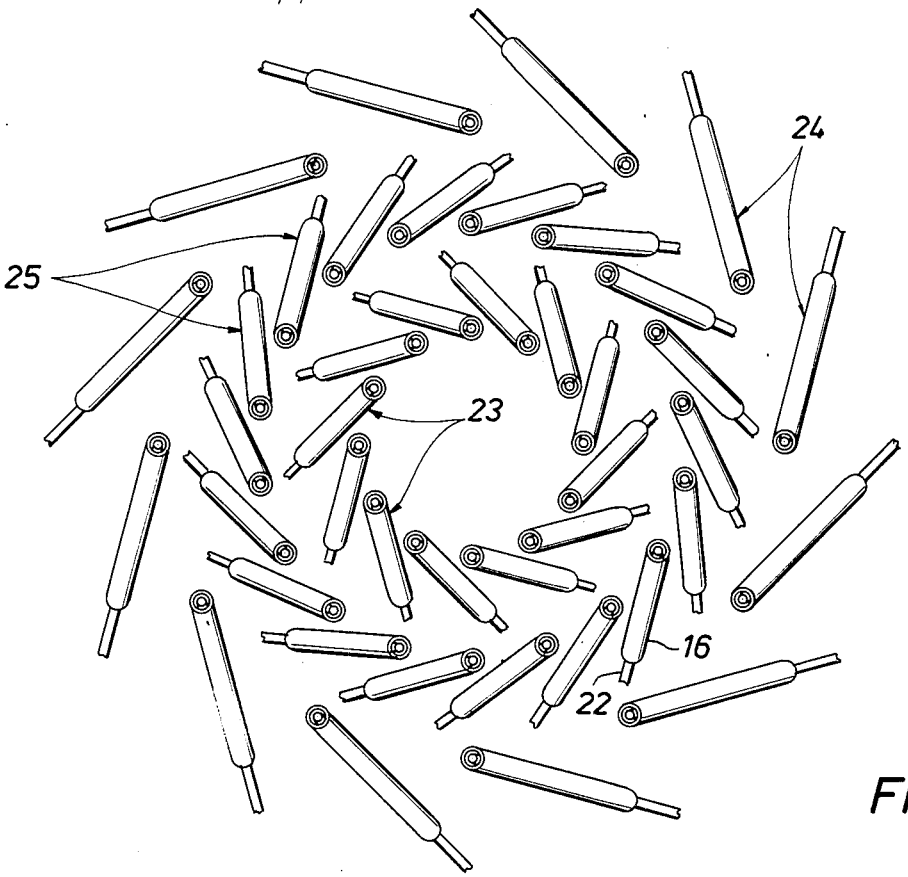
FIG. 5 is a schematic view in cross section taken along lines 5—5 of FIG. 4 illustrating the concentric ring structure of the pile guides and the piles after exiting the guides.

As shown in FIG. 5, a cross-section taken along lines 5—5 of FIG. 4 and therefore through the lower elements of the pile guide support base 28 (not shown for clarity) discloses the orientation of the three concentric rings 23, 24 and 25. The angle of inclination of the inner concentric ring 23 is shown to be opposite the angle of inclination of the middle concentric ring 25. The outer concentric ring 24 can also be seen to have an opposite angle of inclination than the middle concentric ring 25. Piles 22 are shown passing through and extending from some, but not necessarily all, of the pile guides 16 forming each concentric ring 23, 24 and 25.

Referring to FIGS. 4 and 5, it can be seen that each pile 22 within and below the flexure joint 20, 21 (FIG. 1) is inclined with respect to the central vertical axis 15 of the buoyant tower 17 so that upon revolution of any one of said piles 22 about said axis 15 at an essentially constant angle of inclination there is described a surface of revolution which defines a hyperboloid of one sheet. Stated another way, the longitudinal axis of each of said piles 22 when forming the flexure joint 20, 21 lies within a surface of revolution which defines a hyperboloid of one sheet. Each of said piles 22 is inclined in essentially the same direction with respect to the piles 22 adjacent thereto and preferably at essentially the same angle with respect to the central axis 15 of the buoyant tower 17 in order to form concentric rings 23, 24 and 25.

Each of said piles 22 in the preferred embodiment is spaced apart symmetrically from said axis 15 preferably at essentially the same predetermined distance at any given generally horizontally plane located between the flexure joint upper portion 20 and flexure joint lower portion 21 (shown in FIG. 1).

Note that the piles 22 and pile guides 16 forming the middle and outer concentric rings 24, 25 are arranged about the central axis 15 at predetermined distances which are greater than the distance of the piles 22 and the pile guides 16 forming the inner concentric ring 23.

Many other variations and modifications may be made in the apparatus and techniques hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

We claim as our invention:

1. For use in offshore well operations, a buoyant tower structure adapted to extend to the bottom of a body of water having a central vertical axis comprising:

a platform adapted to be positioned above the surface of said water;

a buoyant tank means located adjacent the upper end of said tower structure and being located beneath and connected to said platform;

at least three large diameter legs extending downwardly substantially parallel to said central vertical axis from said buoyant tank means a selected distance, said legs being spaced substantially equally about the circumference of said buoyant tower structure and ending at a selected distance above said ocean floor; and a plurality of pile guides of a diameter less than said legs extending downwardly through and below each of said large diameter legs, the portion of said pile guides extending below said legs curving inward toward each other around the central vertical axis of the lower portion of said tower structure to form a flexure joint housing.

2. For use in offshore well operations, a buoyant tower structure adapted to extend to the bottom of a body of water having a central vertical axis comprising:

a platform adapted to be positioned above the surface of said water;

a buoyant tank means located adjacent the upper end of said tower structure and being located beneath and connected to said platform;

at least three large diameter legs extending downwardly substantially parallel to said central vertical axis from said buoyant tank means a selected distance, said legs being spaced substantially equally about the circumference of said buoyant tower structure and ending at a selected distance above said ocean floor; and a plurality of pile guides of a diameter less than said legs extending downwardly through and below each of said large diameter legs, the portion of said pile guides extending below said legs curving inward towards each other around the central vertical axis of the lower portion of said buoyant tower structure to form a flexure joint housing, and wherein said flexure joint housing is formed by the pile guides at a point where said pile guides are in close proximity to each other about said central vertical axis of said buoyant tower structure, said flexure joint housing adapted to be located adjacent said bottom of said body of water.

3. The apparatus of claim 2 further including piles carried within said pile guides, said piles forming a flexure joint having upper and lower portions, said upper portion being formed by said piles within said flexure joint housing, the lower portion of said piles being adapted to extend downwardly and outwardly below said flexure joint housing into said bottom of said body of water, to form said flexure joint lower portion.

4. The apparatus of claim 3 wherein each pile forming said flexure joint is inclined in substantially the same direction with respect to the pile adjacent thereto and at substantially the same angle with respect to said central axis, said pile being spaced from said axis at a symmetrically arranged predetermined distance when viewed in a horizontal cross-sectional plan view taken at any point of said flexure joint, and with said predetermined distance being less at one generally horizontal plane taken adjacent the bottom of said body of water which passes through said flexure joint than at any other horizontal plane.

5. The apparatus of claim 4 wherein said piles are spaced equidistant from said central axis to form a generally circular pattern.

6. The apparatus of claim 4 wherein said piles forming said flexure joint are vertically slanted and arranged in at least two concentric rings, said vertical slanting piles of one ring inclined with respect to each other in a direction opposite to the direction of the piles of the adjacent ring.

7. The apparatus of claim 6 wherein said piles forming said flexure joint extend downwardly in a clustered arrangement from a single large diameter leg and thereafter form portions of each concentric ring of said flexure joint.

8. The apparatus of claim 7 wherein the longitudinal axis of each of said piles forming said flexure joint lies within a surface of revolution which defines a hyperboloid of one sheet.

9. The apparatus of claim 2 wherein each of said pile guides extends from said platform, and through said large diameter legs, further forming said flexure joint housing.

10. The apparatus of claim 9 wherein a plurality of pile guides extends through at least one large diameter leg.

11. The apparatus of claim 2 further including a pile guide support base connected to said pile guides adjacent the lower ends of said pile guides and carried by the bottom of said body of water, positioned substantially in line with the buoyant tower structure central axis, said support base having a plurality of openings therethrough equal in number to at least the number of piles passing through said openings.

12. The apparatus of claim 2 wherein said flexure joint housing further comprises an enclosure which surrounds and supports at least a portion of said pile guides.

13. A method of tethering a buoyant tower structure having a vertical axis to the bottom of a body of water, said buoyant tower structure provided with buoyant tank means located adjacent the upper end of said tower, and a plurality of pile guides extending downwardly through said buoyant tower structure substantially parallel to said vertical axis, said pile guides thereafter curving inwardly toward each other adjacent the lower end of said tower to form a flexure joint housing, the lower end of said housing connected to a pile guide support base, said buoyant tower structure capable of carrying piles within said pile guides, said method comprising;

floating said structure upon the surface of said body of water;

upending said structure by flooding said buoyant tank means;

embedding the pile guide support base forming the lower end of said structure into the bottom of said body of water; and forming a flexure joint at the lower end of said buoyant structure by;

driving piles through said pile guides into said bottom of said body of water at an inclined angle to the vertical axis of said buoyant tower.

14. The method of claim 13 wherein the step of driving said piles into said body of water at an inclined angle further includes:

driving one portion of said piles into the bottom of said body of water at an angle of inclination to said vertical axis of said buoyant tower structure; and driving at least one other portion of said piles into the bottom of said body of water at an opposite angle of inclination to said vertical axis of said buoyant tower structure.

* * * * *